United States Patent [19]

Wahle et al.

[11] 4,277,678

[45] Jul. 7, 1981

[54] METHOD AND APPARATUS FOR TESTING CIGARETTES OR THE LIKE

[75] Inventors: Günter Wahle, Reinbek; Uwe Heitmann, Schwarzenbek, both of Fed. Rep. of Germany

[73] Assignee: Hauni-Werke Körber & Co Kg., Hamburg, Fed. Rep. of Germany

[21] Appl. No.: 74,330

[22] Filed: Sep. 11, 1979

[30] Foreign Application Priority Data

Sep. 18, 1978 [DE] Fed. Rep. of Germany ..... 2840617

[51] Int. Cl.[3] ..... G01V 9/04

[52] U.S. Cl. ..... 250/223 R; 209/535

[58] Field of Search ..... 250/223 R, 227, 216; 209/535, 522, 523

[56] References Cited

U.S. PATENT DOCUMENTS 3,456,787 7/1969 Pinkham et al. ..... 209/535

3,662,880 5/1972 Kochalski et al. ..... 209/535

3,989,567 9/1976 Benini ..... 250/223 R

*Primary Examiner*—David C. Nelms

*Attorney, Agent, or Firm*—Peter K. Kontler

[57] ABSTRACT

Filter cigarettes of double unit length are tested in the filter tipping machine in a selected portion of their normal path of sidewise movement toward the discharge end of the machine. In such selected portion, successive filter cigarettes are arrested and simultaneously rotated about their respective axes. During rotation, a first optoelectrical unit scans the wrappers of the cigarettes for the presence of protuberances, and a second optoelectrical unit scans the wrappers for the presence of open seams, holes, frayed ends and/or smudges. On detection of defects, the transducers of the respective units generate signals which are used to segregate the respective cigarettes from other cigarettes.

18 Claims, 3 Drawing Figures

METHOD AND APPARATUS FOR TESTING CIGARETTES OR THE LIKE

BACKGROUND OF THE INVENTION

The present invention relates to improvements in testing of rod-shaped articles which constitute or form part of smokers' products. More particularly, the invention relates to a novel and improvement method and to a novel and improved apparatus for testing successive plain or filter tipped cigarettes, cigars or cigarillos, cheroots, filter rod sections or similar rod-like articles (which may consist of natural or reconstituted tobacco, tobacco substitutes, filamentary and/or granular filter material and/or a combination of such substances) while the articles are in the process of moving or about to move sideways, i.e., substantially at right angles to their respective axes.

It is well known to test rod-shaped articles which constitute or form part of smokers' products (for the sake of convenience, such articles will be referred to as cigarettes with the understanding, however, that the invention can be practiced with equal advantage in connection with all or nearly all types of rod-like smokers'products) before the cirgarettes are introduced into packets, boxes or other types of containers for storage or for sale to customers. The testing is intended to uncover the presence of wrappers which exhibit holes, unsatisfactory seams, frayed ends and/or a combination of two or more such defects. As a rule, the testing operation is carried out pneumatically, for example, by establishing a pressure differential between the interior and the exterior of the wrappers of successive cigarettes. If a wrapper exhibits one or more defects of the above outlined character, monitoring of the pressure within or around the defective wrapper will reveal the presence of such defect or defects, and the corresponding cigarette is thereupon segregated from the remaining (satisfactory) cigarettes. The arrangement may be such that the pneumatic testing apparatus generates a signal when the permeability of the wrapper of a cigarette is excessive and/or insufficient, and the signal is used for automatic segregation of the corresponding cigarette. Reference may be had to commonly owned U.S. Pat. Nos. 3,783,677 and 3,962,906 respectively granted Jan. 8, 1974 and June 15, 1976 which show a few recent types of pneumatic testing apparatus for cigarettes or the like.

A drawback of pneumatic testing apparatus is that they are incapable of detecting each and every defect in or on the wrapper of a cigarette or the like. For example, a pneumatic testing apparatus will fail to detect a hole which happens to be plugged, either entirely or in part, by a fragment of tobacco. The hole can be large enough to be readily detectable with the naked eye; nevertheless, even a highly sensitive pneumatic testing apparatus is unlikely to detect such hole if the latter is accidentally sealed by a fragment of a tobacco rib or the like.

A pneumatic testing apparatus is further unlikely to ascertain the presence of certain defects which do not unduly affect the quality of cigarettes but detract from the eye-pleasing appearance of such smokers' products. For example, pneumatic testing apparatus will not detect the presence of a tobacco crumb between the overlapping edge portions of cigarette paper which forms the wrapper, i.e., the presence of a crumb in the seam of the wrapper even though such crumb causes pronounced deformation (bulging) of the corresponding portion of the seam.

Another defect found in cigarettes, especially filter cigarettes, which is not likely to be detected by resorting to a pneumatic testing apparatus is the presence of so-called lips or flags on the convoluted uniting bands which connect plain cigarettes with filter plugs. As a rule, a filter tipping machine makes filter cigarettes of double unit length; each such cigarette is thereupon severed midway between its ends to yield two filter cigarettes of unit length. The cut is made centrally across the convoluted (tubular) uniting band which is used to connect a filter plug of double unit length with two plain cigarettes of unit length. If the uniting band is not applied in an optimum position, it is likely that one of its edges (namely, one of those edges which extends in parallelism with the axis of the filter cigarette of double unit length) will project beyond the confined filter plug and will form a lip which is detectable by the smoker and is likely to lead to detachment of the filter plug from the plain cigarette or cigarettes. The presence of the just discussed flags or lips is often caused by unsatisfactory coating of one side of the uniting band with a suitable adhesive.

British Pat. No. 1,028,372 discloses an apparatus for optically scanning the wrappers of cigarettes or the like. The apparatus of this patent embodies means for withdrawing successive articles to be tested from their normal path, for inserting successively withdrawn articles between two rotating drums, and for optically scanning the articles between the rotating drums. The patented apparatus exhibits several serious drawbacks, especially as concerns the complexity of the withdrawing means. Moreover, the two rotating drums perform no function other than to rotate the articles during optical scanning, and the apparatus occupies a substantial amount of space mainly because it utilizes several components (such as the two drums and the withdrawing means) which serve no other purpose but to allow for optical scanning of articles. Therefore, the just discussed patented apparatus failed to gain widespread acceptance in the industry.

U.S. Pat. No. 3,854,587 discloses a ring-shaped optical testing head for a continuous wrapped tobacco filler which is caused to pass axially through the testing head. During such transport of the wrappecd filler, the optical components on the testing head scan the wrapper of the filler and generate signals which, when indicative of a defective wrapper portion, are used to segregate the corresponding portions of the filler from the remaining (satisfactory) portions. A drawback of such optical scanning apparatus is that the testing operation is carried out too early, i.e., prior to subdivision of the wrapped filler into discrete rod-shaped articles, such as cigarettes or the like. Therefore, and in order to insure segregation of all defective articles (e.g. filter cigarettes of unit length), the apparatus of U.S. Pat. No. 3,854,587 must be followed by a second testing apparatus or the testing operation is unreliable because numerous discrete defective rod-shaped articles are likely to remain undetected prior to insertion into packets or the like.

OBJECTS AND SUMMARY OF THE INVENTION

An object of the invention is to provide a novel and improved method of optically testing cigarettes or like rod-shaped articles in such a way that the articles to be tested need not be withdrawn from their normal path, i.e., from the path along which the articles would advance in the absence of any testing of their wrappers.

Another object of the invention is to provide a method which insures segregation of all defective rod-shaped articles in a time- and space-saving manner.

A further of the invention is to provide a method which can be resorted to for reliable detection of all types of defects in or on the wrappers of cigarettes or the like, including such defects which are likely to remain undetected by a pneumatic testing apparatus.

An additional object of the invention is to provide a simple and reliable method which insures accurate scanning of each and every portion of the wrapper of each of a continuous series of plain or filter tipped cigarettes or other rod-shaped articles which constitute or form part of smokers' products.

Another object of the invention is to provide a novel and improved apparatus for the practice of the above-outlined method.

A further object of the invention is to construct and assemble the apparatus in such a way that each and every rod-shaped article can be scanned during transport along its normal path, ie., along the path which would be acceptable in the absence of any optical testing.

Another object of the invention is to provide the apparatus with novel and improved means which insures that the scanning of wrappers of rod-shaped articles for the presence or absence of defects invariably begins and takes place while the respective article is in an optimum condition and/or position for testing of its wrapper.

One feature of the invention resides in the provision of a method of testing successive rod-shaped articles (such as plain cigarettes, filter cigarettes or the like) which constitute or form part of smokers' products. The method comprises the steps of conveying the articles seriatim sideways along a predetermined path, decelerating successive articles (for example, from a constant speed to zero speed) in a predetermined portion of the path and rotating the declerated articles about their respective axes, and electrooptically scanning each article in the course of the corresponding rotating step.

The scanning step preferably comprises electrooptically monitoring the condition of tubular wrappers of successive articles (in the case of a filter cigarette of double unit length, the wrapper includes the tubular wrappers of the two plain cigarettes, the tubular wrapper (if any) of the filter plug of double unit length between the two plain cigarettes, and the convoluted adhesive-coated uniting band which surrounds the filter plug and connects the latter to the adjacent ends of the two plain cigarettes).

As mentioned above, the decelerating step preferably includes interrupting the sidewise movement of that article which is about to be scanned, i.e., reducing the speed of sidewise movement of the article to zero. The rotating step preferably includes turning the decelerated articles through approximately or exactly 360 degrees to thus insure that each and every portion of the wrapper of each article can be optically scanned before the article leaves the testing station, i.e., the aforementioned portion of the path along which the articles are conveyed.

The scanning step may comprise directing at least one beam of radiation (e.g., light) substantially radially against the rotating article in the predetermined portion of the path and evaluating the beam subsequent to impingement upon the article. Such evaluating can involve directing the beam which is reflected by the wrapper of an article against one or more photoelectronic tranducers whose signals are used to segregate certain articles from the remaining articles if the characteristics of corresponding signals are indicative of defective articles.

The scanning step may also include (in addition to or as a substitute for the just discussed scanning step) directing at least one beam of radiation (e.g., light) in substantial parallelism with the axis of the rotating article so that the beam normally impinges upon a photoelectronic transducer. In the absence of impingement, the tested article is likely to be defective, and the signal at the output of the transducer is then used to effect segregation of such article from the other (satisfactory) articles.

The method preferably further comprises the step of initiating the scanning step in response to start of the rotating step. This insures that an article is invariably scanned while it rotates about its own axis so that the optoelectric or optoelectronic scanning means can monitor the entire external surface of the respective wrapper.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
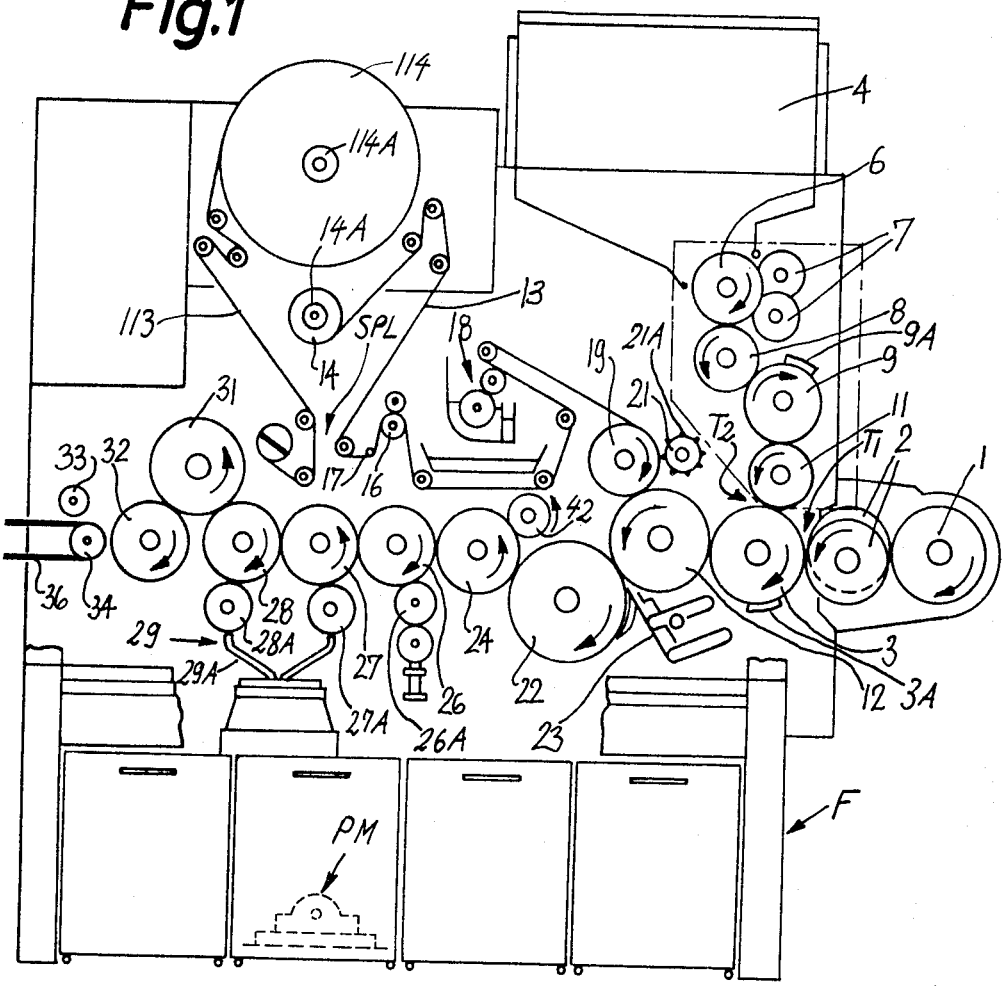
FIG. 1 is a schematic front elevational view of a filter tipping machine embodying a testing apparatus which is constructed and assembled in accordance with a feature of the present invention.

FIG. 1 shows a filter tipping machine of the type known as MAX S (produced by the assignee of the present application). This machine is directly coupled to a cigarette maker so that it receives pairs of plain cigarettes PC (see FIG. 3) of unit length. The frame F of the filter tipping machine supports a rotary drum-shaped row-forming conveyor 1 which forms part of the cigarette maker and has peripheral flutes for plain cigarettes of unit length. The arrangement is such that the cigarette maker feeds a discrete plain cigarette PC into each flute of the conveyor 1 and that the plain cigarettes form two rows wherein the cigarettes move sideways. The cigarettes of one row are held in the oddly numbered flutes and are nearer to one axial end of the conveyor 1, and the cigarettes of the other row are held in the evenly numbered flutes and are nearer to the other axial end of the conveyor 1.

The filter tipping machine comprises two rotary drum-shaped aligning conveyors 2 each of which serves to deliver plin cigarettes PC of a discrete row from the row forming conveyor 1 to a transfer station T1 where the cigarettes PC enter successive flutes of a rotary drum-shaped assembly conveyor 3. The conveyors 2 are driven at different speeds and/or transport the cigarettes PC of the respective rows through different distances so that each flute of the assembly conveyor 3 which reaches the transfer station T1 receives two coaxial plain cigarettes PC of unit length. The width of the gap between two plain cigarettes PC in a flute which reaches the station T1 at least equals and normally at least slightly exceeds the length of a filter rod section or filter plug FP (see FIG. 3) of double unit length.

The frame F further supports a magazine 4 for a supply of filter rod sections of six times unit length. The outlet of the magazine 4 receives a portion of a rotary drum-shaped severing conveyor 6 which is formed with peripheral flutes to transport discrete filter rod sections of six times unit length past two rotary disk-shaped knives 7. The knives 7 are spaced apart from each other, as considered in the axial and circumferential direction of the severing conveyor 6, and cooperate with the latter to subdivide each filter rod section of six times unit length into a set of three coaxial filter plugs FP of double unit length. Successive sets of filter plugs FP are transferred onto a rotary staggering conveyor 8 having three disk-shaped rotary portions, each of which receives and advances one filter plug FP of each set. The three portions rotate at different speeds and/or transport the respective filter plugs FP through different distances so that each set of originally coaxial plugs FP is converted into a row of three axially staggered filter plugs which are disposed one behind the other, as considered in the circumferential direction of the staggering conveyor 8. The portions of the conveyor 8 deliver discrete filter plugs FP into successive flutes of a rotary drum-shaped shuffling conveyor 9 which cooperates with two stationary cams 9A to convert the axially staggered filter plugs FP into a single row wherein each preceding plug is in exact register with the next-following plug. The shuffling conveyor 9 delivers successive filter plugs FP of the single row into successive peripheral flutes of a rotary drum-shaped accelerating conveyor 11 which inserts such filter plugs into successive flutes of the assembly conveyor 3 at a transfer station T2 preceding the transfer station T1, as considered in the direction of rotation of the conveyor 3. The filter plugs FP are inserted in such a way that, once the respective flute of the assembly conveyor 3 reaches the transfer station T1, each freshly inserted filter plug is flanked by two coaxial plain cigarettes PC of unit length. In other words, each of those flutes of the assembly conveyor 3 which advance beyond the transfer station T1 contains a group of three coaxial rod-shaped articles including a centrally located filter plug FP of double unit length and two plain cigarettes PC of unit length. Such groups are caused to advance between two stationary cams 3A which cause the plain cigarettes PC to move axially toward and into contact with the adjacent ends of the respective filter plug FP, i.e., the groups are shortened or condensed prior to entering the flutes of a rotary drum-shaped transfer conveyor 12.

The frame F also supports a spindle 14A for a reel or bobbin 14 of flexible wrapping material 13 (e.g., a web of cigarette paper or imitation cork) which is used for the making of uniting bands UB, i.e., of short square or rectangular patches of wrapping material which are employed to connect the filter plugs FP of successive groups with the respective plain cigarettes PC so that each group constitutes a filter cigarette 37 of double unit length. The web 13 is drawn off the reel 14 by a pair of rotary advancing rolls 16 and is caused to move past and to engage the relatively sharp edge of a so-called curling device 17, e.g., a device of the type disclosed in commonly owned U.S. Pat. No. 3,962,957 granted June 15, 1957, to Alfred Hinzmann. The purpose of the curling device 17 is to equalize internal stresses in the web 13 so that the latter can be readily converted into a succession of uniting bands each capable of establishing an airtight seal between a filter plug FP and the respective plain cigarettes PC.

The web 13 thereupon advances along a paster 18 which serves to coat one side of the web with a suitable adhesive paste before the web reaches a rotary suction drum 19. The cylindrical peripheral surface of the drum 19 is formed with ports (not shown) which surround and communicate with a suction chamber so that the peripheral surface of the drum 19 attracts the leader of the web 13 and causes such leader to advance past a rotary carrier 21 for knives 21A serving to sever the leader of the web 13 at regular intervals and to thereby form a succession of discrete uniting bands UB each having one of its sides coated with adhesive supplied by the paster 18. The peripheral speed of the drum 19 preferably somewhat exceeds the speed of lengthwise movement of the web 13 so that successive uniting bands UB are automatically separated from each other and are attached to successive groups of rod-shaped articles on the transfer conveyor 12. The mode of attachment is preferably such that each uniting band UB adheres to the corresponding filter plug FP and to the inner end portions of the respective plain cigarettes PC. The properly attached uniting bands UB are preferably tangential or nearly tangential to the corresponding groups of articles on the transfer conveyor 12, and each such group (with a uniting band adhering thereto) is thereupon transferred onto a rotary drum-shaped wrapping conveyor 22 which cooperates with a stationary or mobile rolling device 23 to cause each group to rotate about its own axis and to thus convert the respective uniting band UB into a tube (see FIG. 3) which sealingly surrounds the respective filter plug FP and the adjacent inner end portions of the corresponding plain cigarettes PC. Thus, the parts 22, 23 cooperate to convert each group and a uniting band into a filter cigarette 37 of double unit length. The manner in which the conveyor 22 cooperates with a stationary or mobile rolling device to convert uniting bands UB into tubes is disclosed in commonly owned U.S. Pat. No. 3,527,234 to Alfred Hinzmann, granted Sept. 8, 1970.

Successive filter cigarettes 37 of double unit length are transferred onto a rotary drum-shaped drying conveyor 24 which is heated from within and serves to promote setting of the adhesive applied by the paster 18. In addition, the conveyor 24 forms part of the improved testing apparatus and defines a predetermined portion of the elongated path along which the cigarettes 37 are moved sideways through the filter tipping machine of FIG. 1.

The conveyor 24 delivers successive filter cigarettes 37 to a rotary drum-shaped severing conveyor 26 which cooperates with a rotary disk-shaped knife 26A to sever each filter cigarette 37 midway between its ends (along the broken line BL shown in FIG. 3) so that each cigarette 37 yields two filter cigarettes of unit length. As mentioned above, the conveyor 24 forms part of the improved testing apparatus. Articles (i.e., filter cigarettes 37 or filter cigarettes of unit length) which are found to be defective during travel with the conveyor 24 are or can be segregated from other (satisfactory) articles during transport with the severing conveyor 26.

Since the cigarettes 37 are severed midway across their convoluted uniting bands UB, the filter plugs (of unit length) of each pair of filter cigarettes of unit length on the severing conveyor 26 are adjacent to each other. This is undesirable since, when in a packet, the filter cigarettes are normally stored in such a way that all filter tips face in the same direction. Therefore, the filter tipping machine of FIG. 1 further comprises a so-called turn-around or inverting device 29 which turns one filter cigarette of each pair through 180 degrees before the filter cigarettes of unit length are conveyed on to a packing machine or into storage. The turn-around device 29 is of the type disclosed in commonly owned U.S. Pat. No. 3,583,546 granted June 8, 1971 to Gerhard Koop, and comprises a first rotary drum-shaped conveyor 27 which receives pairs of filter cigarettes of unit length from the severing conveyor 26. One filter cigarette of each pair is transferred onto a second rotary drum-shaped conveyor 27A of the device 29 and the remaining filter cigarettes are transferred from the conveyor 27 into alternate peripheral flutes of a third rotary drum-shaped conveyor 28. The device 29 further comprises a set of orbiting arms 29A which remove filter cigarettes of unit length from the flutes of the conveyor 27A, turn such filter cigarettes through 180 degrees, and insert the inverted filter cigarettes into successive flutes of a fourth rotary drum-shaped conveyor 28A of the turn-around device 29. The conveyor 28A inserts the inverted filter cigarettes of unit length into the empty flutes of the conveyor 28, preferably in such a way that the inverted and non-inverted cigarettes form a single row which is transferred into the peripheral flutes of a rotary drum-shaped testing conveyor 31. The latter serves to test the quality of the tobacco-containing ends of successive filter cigarettes of unit length and delivers the tested cigarettes to a rotary drum-shaped intermediate conveyor 32. The conveyor 32 can also serve as a part of means for ejecting filter cigarettes which have been found to be defective during testing on the conveyor 31. Satisfactory filter cigarettes of unit length are transferred onto the upper reach of an endless belt or band conveyor 36 which delivers the cigarettes to the hopper of a packing machine, to a pneumatic sender, to storage or to a so-called mass flow linkup equipment, e.g., to equipment known as Resy and manufactured by the assignee of the present application. The conveyor 36 is trained over pulleys 34. The illustrated pulley 34 cooperates with a braking drum 33 which is mounted above the upper reach of the conveyor 36.

The frame F further supports a second spindle 114A for a fresh reel 114 which contains a supply of convoluted web material 113. The leader of the fresh web 113 is located at a splicing station SPL and is ready to be attached to the running web 13 as soon as the supply of web 13 on the expiring reel 14 is reduced to a predetermined value. Reference may be had to commonly owned U.S. Pat. No. 3,730,811 granted May 1, 1973, to Hans-Joachim Wendt which describes a splicing device capable of being used at the station SPL to attach the trailing portion of a running web to the leader of a fresh web.

All or nearly all rotary or otherwise movable components of the filter tipping machine receive torque or other motion from a main prime mover PM which preferably also drives the mobile parts of the aforediscussed cigarette maker including the row forming conveyor 1.

The improved testing apparatus comprises the aforementioned drying conveyor 24 (see also FIG. 2) and a roller-shaped rotary element 42 which is adjacent to but spaced apart from the conveyor 24. Each freshly formed filter cigarette 37 of double unit length is automatically transferred from the conveyor 22 onto the conveyor 24 and is caused to move toward the rotary element 42 to thereby begin to rotate about its own axis while one or more optoelectrical units scan its wrapper. Simultaneous engagement of the wrapper of a cigarette 37 by the conveyor 24 and rotary element 42 entails a deceleration of such cigarette, preferably to zero speed (as concerns the sidewise movement of the cigarette in a direction from the conveyor 22 toward the severing conveyor 26). This is advisable in order to insure that the optoelectrical scanning unit or units need not move back and forth along that portion of the path of cigarettes 37 wherein the cigarettes are caused to rotate about their respective axes.

Figure 2:
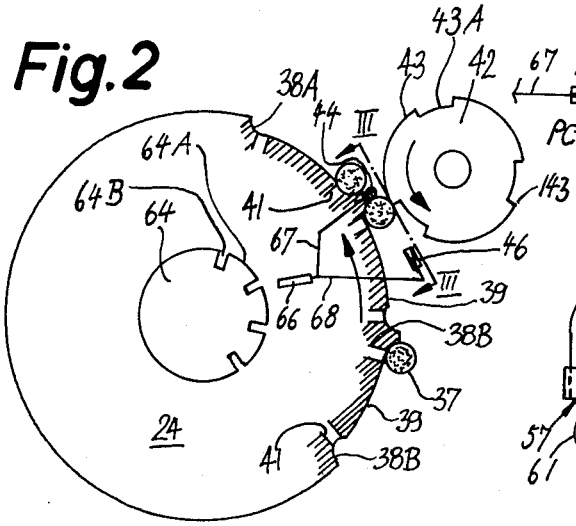
FIG. 2 is a greatly enlarged partly sectional view of the testing apparatus in the filter tipping machine of FIG. 1.

The periphery of the conveyor 24 is formed with several (e.g., eight) convex peripheral surfaces or facets 39 each of which is flanked by two flutes 38A, 38B extending in parallelism with the axis of the conveyor 24. The transfer of cigarettes 37 from the conveyor 22 onto the conveyor 24 takes place in such a way that the cigarettes are delivered into successive flutes 38A. Each of the flutes 38A, 38B has one or more suction ports 41 which are connected with a suction chamber or directly with a suction generating device (e.g., the intake of a fan) during those stages of angular movement of the conveyor 24 when the cigarettes 37 are to be held in the respective flutes 38A or 38B. The prime mover PM of the filter tipping machine drives the conveyor 24 in a counterclockwise direction, as viewed in FIG. 1 or 2. At the same time, the rotary element 42 is also driven in the counterclockwise direction, and this element has several (e.g., three) convex peripheral surfaces or facets 43 whose peripheral speed matches that of the surfaces 39 on the conveyor 24. The surfaces 43 are separated from each other by recesses 43A. The maximum distance between a surface 39 on the conveyor 24 and the nearest surface 43 on the rotary element 42 is preferably slightly less than the diameter of a cigarette 37; this insures that the cooperating surfaces 39 and 43 define gaps having a width which is slightly less than the diameter of a cigarette whereby the cigarettes 37 are caused to roll about their own axes as soon as their wrappers are simultaneously engaged by a surface 39 as well as by a surface 43. Once the rotation of a cigarette 37 ends, such cigarette rests in and is attracted to the corresponding flute 38B during further transport toward the severing conveyor 26. The sidewise movement of a cigarette 37 is interrupted during simultaneous engagement with the surfaces 39, 43, i.e., a cigarette moves sideways while it is held in the corresponding flute 38A or 38B. The length of each surface 43, as considered in the circumferential direction of the rotary element 42, preferably equals or closely approximates the length of a surface 39, as considered in the circumferential direction of the conveyor 24. As shown in FIG. 2, once a cigarette 37 is simultaneously engaged by the conveyor 24 and rotary element 42, the corresponding surfaces 39, 43 engage the wrapper of such cigarette at two points (substantially along two lines) which are disposed diametrically opposite each other.

Figure 3:
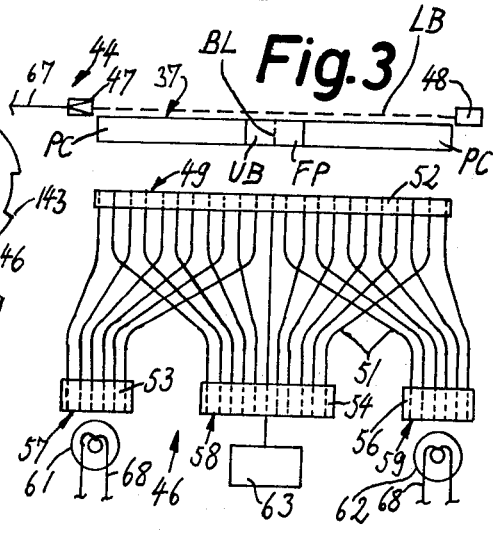
FIG. 3 is a view as seen in the direction of arrows from the line III—III of FIG. 2.

The testing apparatus of FIGS. 2 and 3 comprises two discrete photosensitive optoelectrical testing units including a unit 44 which serves to detect the presence of protuberances or other projections on successive cigarettes 37, and a unit 46 which directs one or more beams of radiation substantially radially against the wrappers of successive cigarettes 37 while such cigarettes rotate about their respective axes. The unit 46 can detect holes, frayed ends, unsatisfactory seams and similar defects of the wrappers.

The testing unit 44 comprises a source 47 of radiation, preferably a suitable light source, which directs a beam LB of light in parallelism with that cigarette 37 which rotates between two cooperating surfaces 39, 43. The light beam LB is immediately adjacent to the external surface of the wrapper of a satisfactory cigarette 37 and then impinges upon a suitable transducer 48 shown in FIG. 3. If the light beam LB between the source 44 and the transducer 48 is interrupted while a cigarette 37 rotates about its axis, such interruption is attributable to a projection on the wrapper of the respective cigarette 37, e.g., to the presence of a crumb in the seam of the wrapper and/or to the presence of a lip or flag which develops as a result of unsatisfactory coating of a uniting band UB with adhesive paste and unsatisfactory draping of such uniting band around the corresponding filter plug FP and plain cigarettes PC.

The testing unit 46 comprises a plurality of light conducting glass fibers 51 each of which has an end portion adjacent to the path portion where successive cigarettes 37 rotate about their respective axes. The end faces of such end portions of the fibers 51 together form an elongated surface 49 which faces successive rotating wrappers. The surface 49 is surrounded by a holder 52 which is mounted on or in the frame F of the filter tipping machine. The holder 52 preferably consists of a suitable synthetic plastic material. The number of fibers 51 can greatly exceed the illustrated number. The length of the surface 49 equals or approximates the length of a filter cigarette 37 (see FIG. 3). The end portions which form the surface 49 can be softened by partial melting prior to insertion into the holder 52.

The other end portions of light conducting fibers 51 form three bundles which are respectively confined in holders 53, 54 and 56. The end faces of the leftmost bundles of FIG. 3 form an elongated surface 57 which can receive light from a first light source 61 (e.g., a suitable electric lamp). The end faces of the rightmost bundle of FIG. 3 form a surface 59 which can receive light from a source 62 similar or identical to the source 61. The end faces of the median bundle of FIG. 3 form a surface 58 which can transmit light to a photoelectric transducer 63.

FIG. 3 shows that the fibers 51 of the median bundle (holder 54) alternate with the other fibers 51. The fibers 51 of the left-hand bundle (holder 53) transmit light to the left-hand half of the wrapper of the filter cigarette 37 shown in FIG. 3, and the fibers of the right-hand bundle (holder 56) transmit light to the right-hand half of the wrapper of such cigarette. It will be noted that the upper end portions of fibers 51 which constitute the median bundle (holder 54) are distributed along the full length of the surface 49. Therefore, such fibers can direct against the transducer 63 light beams which issue from the fibers 51 of the other two bundles (holders 53, 56) and are reflected by the corresponding portions of the wrappers of a rotating cigarette 37 at the testing station. The reflected light is uniformly distributed along the photosensitive surface of the transducer 63 because each fiber 51 of the median bundle is located (at the surface 49) between two fibers of the right-hand or left-hand bundle.

The testing apparatus further comprises means for synchronizing the operation of the testing unit 44, 46 with rotary movement of succcessive cigarettes 37, i.e., for initiating the scanning steps which are carried out by the units 44, 46 in response to start of successive rotary steps initiated by the conveyor 24 and rotary element 42. Such synchronizing means comprises a disk 64 with lobes 64A and a proximity detector switch 66 cooperating with the lobes 64A. The switch 66 is connected with the light sources 61, 62 by conductor means 68, and with the light source 47 by conductor means 67. The disk 64 is driven by the prime mover PM so that it rotates with the conveyor 24, and the switch 66 interrupts or opens the circuits of the light sources 47, 61, 62 whenever it registers with a slot 64B between two neighboring lobes 64A of the disk 64.

The exact manner in which the transducers 48, 63 evaluate the signals and generate signals for ejection of defective articles 37 is known; therefore, the details of the ejecting means which are connected with the outputs of the transducers 48, 63 are not shown in the drawing. The ejecting means may comprise a solenoid-operated valve which opens a conduit for compressed air whenever it receives a signal denoting the detection of a defective cigarette 37, whereby the compressed air expels the defective article from the flute of the severing conveyor 26.

The operation is as follows:

Each filter cigarette 37 which is transferred into the oncoming flute 38A of the conveyor 24 is set in rotary motion as soon as its wrapper is engaged by the leading edge 143 of the oncoming surface 43 on the rotary element 42. At the same time, the proximity detector switch 66 activates the testing units 44, 46 so that the scanning of the wrapper of the cigarette 37 between the components 24 and 42 begins as soon as such cigarette starts to rotate about its own axis. The length of the surfaces 39 and 42 is preferably such that each cigarette 37 rotates through approximately or exactly 360 degrees; this insures complete scanning of the entire wrapper of each and every cigarette 37. As a cigarette 37 begins to rotate about its own axis, it leaves the respective flute 38A, rolls along the respective surface 39 of the conveyor 24, and ultimately enters the corresponding flute 38B. This terminates the rotary movement of the freshly tested cigarette, i.e., such cigarette resumes its sidewise movement with the conveyor 24 and is transferred into the oncoming flute of the severing conveyor 26.

The testing unit 44 scans the rotating wrapper for the presence or absence of projections or protuberances, such as the aforediscussed crumbs in the seams and/or the flags or lips of improperly convoluted uniting bands UB. On detection of a crumb and/or flag, the output of the transducer 48 transmits a signal which is used to segregate the respective cigarette 37 from other (satisfactory) cigarettes.

The testing unit 46 ascertains the presence of holes, frayed ends, open seams and/or similar defects, and its transducer 63 then transmits a signal which is used for segregation of the corresponding cigarette 37 from satisfactory cigarettes. For example, when the light beams which issue from the upper ends of the left-hand bundle of fibers 51 shown in FIG. 3 are reflected (or are improperly reflected) by tabacco which is visible through a hole in the wrapper of the left-hand plain cigarette PC of FIG. 3, the corresponding fibers 51 of the median bundle fail to supply requisite amounts of reflected light to the surface 58 whereby the transducer 63 transmits a signal which is indicative of a defective cigarette 37. The same holds true when the wrapper of the one or the other cigarette PC and/or the wrapper (convoluted uniting band (UB) of the filter plug FP contains a dark spot (e.g., a smudge or a particle of tobacco which adheres to the exterior of such wrapper).

It is preferred to regulate the suction in ports 41 of the flute 38A in such a way that suction is reduced or terminated (at least at both ends of the flute 38A) when a cigarette 37 is about to start to roll about its own axis, i.e., when the cigarette is to leave the flute 38A in order to roll along a surface 39 (i.e., to interrupt its sidewise movement as a result of simultaneous contact with a surface 39 as well as with a surface 43).

When the testing of a cigarette 37 is completed, such cigarette enters the oncoming flute 38B and reassumes its sidewise movement with the conveyor 24. The flute 38B then transfers such cigarette into the oncoming flute of the severing conveyor 26. The ports 41 of the flute 38B are connected to the suction generating device not later than when such flute receives a freshly tested cigarette 37, and the ports 41 remain connected with the suction generating device until the freshly tested cigarette 37 reaches the transfer station between the conveyors 24 and 26. The rotary element 42 cannot interfere with sidewise movement of freshly tested cigarettes 37 because the depth of recesses 43A in the periphery of the element 42 suffices to insure that the freshly tested articles can move sideways, without any hindrance, as soon as their wrappers are disengaged from the respective surfaces 43.

The proximity detector switch 66 automatically deactivates the testing units 44, 46 as soon as a freshly tested cigarette 37 enters the respective flute 38B.

If desired, the surfaces 39 and/or 43 can be grooved, channeled, coated with friction generating material and/or otherwise roughened to reduce the likelihood of slippage of such surfaces with respect to the wrapper of a cigarette 37 therebetween.

An important advantage of the improved method and apparatus is that the articles to be tested need not be moved from their customary path, i.e., that the testing takes place in a predetermined portion of the customary path along which the rod-shaped articles advance in a filter tipping or like machine. It is clear that the testing apparatus can be installed downstream of the severing conveyor 26 to scan filter cigarettes of unit length. Also, the testing apparatus can be used with equal advantage in a cigarette maker, in a machine for the manufacture of filter plugs, in a machine for the making of plain or filter tipped cigars or cigarillos and/or in any other machine which produces and/or processes rod-shaped articles forming part of or constituting smokers' products.

The possibility of testing successive cigarettes during transport along their normal or accustomed path brings about many important and unobvious advantages. Thus, successive testing operations can be carried out at the rate at which the machine produces and/or processes rod-shaped articles, the likelihood of misalignment of articles during transfer from or back into their normal paths is eliminated, and the wrappers of the cigarettes are less likely to be damaged and/or defaced as a result of total absence of the need for transfer from the normal path.

Another important advantage of the improved method and apparatus is that the wrapper of each and every cigarette can be readily tested to ascertain the presence or absence of practically all defects, namely, defects which can and defects which cannot be ascertained by resorting to pneumatic testing apparatus. Adequate testing or scanning of each and every portion of each wrapper is insured by rotating the articles through angles of approximately or exactly 360 degrees.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. A method of testing successive rod-shaped articles which constitute or form part of smokers' products, comprising the steps of conveying the articles seriatim sideways along a predetermined path; decelerating successive articles in a predetermined portion of said path and rotating the decelerated articles about their respective axes; and optoelectrically scanning each article in the course of the corresponding rotating step.

2. The method of claim 1, wherein each of said articles comprises a tubular wrapper and said scanning step comprises monitoring the condition of the wrappers.

3. The method of claim 1, wherein said decelerating step includes interrupting the sidewise movement of the respective articles.

4. The method of claim 1, wherein said rotating step includes turning each article through substantially 360 degrees about its respective axis.

5. The method of claim 1, wherein said scanning step includes directing at least one beam of radiation substantially radially against the rotating articles and evaluating the beam subsequent to impingement upon the article.

6. The method of claim 1, wherein said scanning step includes directing at least one beam of radiation in substantial parallelism with the axis of the rotating article.

7. The method of claim 1, further comprising the step of initiating said scanning step in response to start of said rotating step.

8. Apparatus for testing successive rod-shaped articles which constitute or form part of smoker's products, comprising means for conveying the articles seriatim sideways along a predetermined path; means for decelerating successive articles in a predetermined portion of said path and for rotating the decelerated articles about their respective axes; and means for optoelectrically scanning each article in said predetermined portion of said path.

9. The apparatus of claim 8, wherein said conveying means comprises at least one first rolling surface and said decelerating means comprises at least one second rolling surface which is adjacent to but spaced from said first rolling surface when an article enters said portion of said path, said portion of said path being located between said surfaces and the maximum distance between said surfaces being at most equal to the diameter of an article.

10. The apparatus of claim 9, further comprising means for moving said surfaces in a given direction and at a predetermined speed so that the sidewise movement of an article is interrupted while such article is engaged and rotated by said first and second surfaces.

11. The apparatus of claim 1, wherein said moving means includes means for rotating said surfaces about fixed axes.

12. The apparatus of claim 8, wherein said scanning means comprises at least one photosensitive testing unit including at least one source of radiation arranged to direct at least one beam of radiation substantially radially against the article which rotates in said portion of said path and means for evaluating said beam subsequent to impingement upon the respective article.

13. The apparatus of claim 8, wherein said scanning means comprises at least one photosensitive testing unit including a plurality of light conductors having end portions disposed in a row extending in substantial parallelism with the axis of an article which rotates in said portion of said path.

14. The apparatus of claim 8, wherein said scanning means comprises at least one photosensitive testing unit including a source of radiation arranged to direct at least one beam of radiation adjacent to and in substantial parallelism with the axis of an article rotating in said portion of said path and transducer means disposed in the path of said beam.

15. The apparatus of claim 8, wherein said conveying means comprises a rotary drum-shaped conveyor having at least one peripheral rolling surface and a pair of flutes flanking said surface, an article entering said portion of said path being disposed in one of said flutes and such article entering the other of said flutes upon completion of rotation about its axis.

16. The apparatus of claim 8, wherein said decelerating means comprises a rotary element having a plurality of peripheral surfaces separated by recesses, successive articles entering said portion of said path being engaged by successive surfaces of said rotary element to be thereby rotated about their respective axes with said element rotates relative to said conveying means.

17. The apparatus of claim 16, wherein said conveying means comprises a rotary drum having a plurality of peripheral surfaces which engage successive articles in said portion of said path while an article is also engaged by a surface of said rotary element, the length of said surfaces of said rotary drum, as considered in the circumferential direction of said drum, at least closely approximating the length of the surfaces of said rotary element, as considered in the circumferential direction of said element.

18. The apparatus of claim 17, wherein said drum has several pairs of peripheral flutes, one pair for each of the respective peripheral surfaces, the flutes of each pair flanking the respective surface of said drum and successive articles of said series entering one flute of the respective pair at the time of entry into said portion of said path and thereupon the other flute of the respective pair upon completion of rotation about the respective axis.

* * * * *